US011029619B2

(12) United States Patent
Almoznino et al.

(10) Patent No.: US 11,029,619 B2
(45) Date of Patent: Jun. 8, 2021

(54) PRINT SEQUENCE IN AN ELECTROPHOTOGRAPHIC PRINTER

(71) Applicant: Hewlett-Packard Development Company, L.P., Spring, TX (US)

(72) Inventors: Elhanan Almoznino, Ness Ziona (IL); Dror Kella, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/957,190

(22) PCT Filed: Jan. 8, 2018

(86) PCT No.: PCT/US2018/012727
§ 371 (c)(1),
(2) Date: Jun. 23, 2020

(87) PCT Pub. No.: WO2019/135763
PCT Pub. Date: Jul. 11, 2019

(65) Prior Publication Data

US 2020/0333722 A1 Oct. 22, 2020

(51) Int. Cl.
*G03G 15/01* (2006.01)
*G03G 15/16* (2006.01)

(52) U.S. Cl.
CPC ..... *G03G 15/0131* (2013.01); *G03G 15/1665* (2013.01)

(58) Field of Classification Search
CPC ..... G03G 15/0131; G03G 15/1665; G03G 15/167; G03G 15/1675
See application file for complete search history.

(56) References Cited

U.S. PATENT DOCUMENTS

| | | | |
|---|---|---|---|
| 4,144,808 | A | 3/1979 | Iwasa et al. |
| 4,974,027 | A | 11/1990 | Landa et al. |
| 8,320,817 | B2 | 11/2012 | Zaretsky |
| 8,655,241 | B2 | 2/2014 | Zaretsky et al. |
| 2017/0212455 | A1 | 7/2017 | Portnoy et al. |

FOREIGN PATENT DOCUMENTS

| | | | |
|---|---|---|---|
| WO | WO-2007050085 | A1 | 5/2007 |
| WO | WO-2016000747 | A1 | 1/2016 |
| WO | WO-2017121476 | | 7/2017 |

OTHER PUBLICATIONS

Boaz, B., HP-indigo Technology and Its Application to Photo Printing, Jan. 1, 2012, http://www.ingentaconnect.com/content/ist/tdpf/2012/00002012/00000001/art00008.

*Primary Examiner* — Hoang X Ngo
(74) *Attorney, Agent, or Firm* — Michael A Dryja

(57) ABSTRACT

An example method of printing images in an electrophotographic printer is provided. The method includes developing a first image on a first portion of an intermediate transfer member by receiving a first sequence of color separations from a photo imaging member, and developing a second image on a second portion of the intermediate transfer member by receiving a second sequence of color separations from the photo imaging member. A voltage is applied to the intermediate transfer member during receipt of each color separation from the photo imaging member. During development of the second image at least one null separation is inserted into the second sequence of color separations. During a period for the null separation, a voltage applied to the intermediate transfer member is reduced and the first image is transferred to a conductive substrate.

13 Claims, 6 Drawing Sheets

| Blanket A | Blanket B |
|---|---|
| 1 | dummy |
| 2 | 1 |
| 3 | 2 |
| 4 | n |
| n | 3 |
| 1 | 4 |
| n | n |
| 2 | 1 |
| 3 | 2 |
| 4 | n |
| n | 3 |
| 1 | 4 |
| n | n |

Figure 4a

| Blanket A | Blanket B |
|---|---|
| 1 | dummy |
| 2 | 1 |
| 3 | n |
| n | 2 |
| 1 | 3 |
| n | n |
| 2 | 1 |
| 3 | n |
| n | 2 |
| 1 | 3 |
| n | n |

Figure 4b

| Blanket A | Blanket B |
|---|---|
| 1 | dummy |
| 2 | dummy |
| 3 | 1 |
| 4 | 2 |
| 5 | n |
| n | 3 |
| 1 | 4 |
| 2 | 5 |
| n | n |
| 3 | 1 |
| 4 | 2 |
| 5 | n |
| n | 3 |
| 1 | 4 |
| 2 | 5 |

Figure 4c

| Blanket A | Blanket B |
|---|---|
| 1 | dummy |
| 2 | dummy |
| 3 | 1 |
| 4 | 2 |
| n | n |
| n | 3 |
| 1 | 4 |
| 2 | n |
| n | n |
| 3 | 1 |
| 4 | 2 |
| n | n |
| n | 3 |
| 1 | 4 |
| 2 | n |
| n | n |
| 3 | 1 |

Figure 5a

| Blanket A | Blanket B |
|---|---|
| 1 | dummy |
| 2 | 1 |
| 3 | 2 |
| n | n |
| n | 3 |
| 1 | n |
| n | n |
| 2 | 1 |
| 3 | 2 |
| n | n |
| n | 3 |
| 1 | n |
| n | n |
| 2 | 1 |
| 3 | 2 |

Figure 5b

| Blanket A | Blanket B |
|---|---|
| 1 | dummy |
| 2 | dummy |
| 3 | 1 |
| 4 | 2 |
| 5 | 3 |
| n | n |
| n | 4 |
| 1 | 5 |
| 2 | n |
| n | n |
| 3 | 1 |
| 4 | 2 |
| 5 | 3 |
| n | n |
| n | 4 |
| 1 | 5 |
| 2 | n |
| n | n |
| 3 | 1 |

Figure 5c

PRINT SEQUENCE IN AN ELECTROPHOTOGRAPHIC PRINTER

BACKGROUND

Electrophotographic printing refers to a process of printing in which a printing substance (e.g., a liquid or dry electrophotographic ink or toner) can be applied onto a surface having a pattern of electrostatic charge. The printing substance conforms to the electrostatic charge to form an image in the printing substance that corresponds to the electrostatic charge pattern. An electrophotographic printer may use digitally controlled lasers to create a latent image in a charged surface of an imaging element such as a photo imaging plate (PIP). In this process, a uniform static electric charge is applied to the photo imaging plate and the lasers dissipate charge in certain areas creating the latent image in the form of an invisible electrostatic charge pattern corresponding to one "separation" of the image to be printed. An electrically charged printing substance, in the form of dry or liquid toner, is then applied and attracted to the partially-charged surface of the photo imaging plate, recreating a color separation, in the form of a layer of printing substance, of the desired image.

In certain electrophotographic printers, a transfer member, such as an intermediate transfer member (ITM) is used to transfer developed toner to a print medium. For example, a developed image, comprising toner aligned according to a latent image, may be transferred from a photo imaging plate to a transfer blanket of an intermediate transfer member. This transfer occurs via predominantly electrical and mechanical forces that exist between the charged toner and the intermediate transfer member which is often biased at a particular voltage level. Pure mechanical force, using zero electrical potential difference between the blanket of the intermediate transfer member and toner produces poor print quality. From the intermediate transfer member, the toner is transferred to a desired substrate, which is placed into contact with the transfer blanket.

At least two different methodologies may be used to print multi-color images on an electrophotographic printer. These involve the generation of multiple separations, in the form of multiple layers of a printing substance, where each separation is a single-color partial image. When these separations are superimposed, they result in the desired full color image being formed. In a first methodology, a color separation layer is generated on the photo imaging plate, transferred to the intermediate transfer member and is finally transferred to a substrate. Subsequent color separation layers are similarly formed and are successively transferred to the substrate on top of the previous layer(s). This is sometimes known as a "multi-shot" imaging sequence. In a second methodology, a "one-shot" imaging process is used. In these systems, the photo imaging plate transfers a succession of separations to the transfer blanket on the intermediate transfer member, building up each separation layer on the blanket. Once a predetermined number of separations are formed on the transfer blanket, they are all transferred to the substrate together.

BRIEF DESCRIPTION OF THE DRAWINGS

Various features of the present disclosure will be apparent from the detailed description which follows, taken in conjunction with the accompanying drawings, which together illustrate features of the present disclosure, and wherein:

FIGS. 4*a*-4*c* are tables showing example print sequences for four, three and five color separations, respectively;

FIGS. 5*a*-5*c* are tables showing example print sequences for four, three and five color separations, respectively, in which a longer voltage rise or fall than that of FIGS. 4*a*-4*c* occurs.

DETAILED DESCRIPTION

Figure 1:
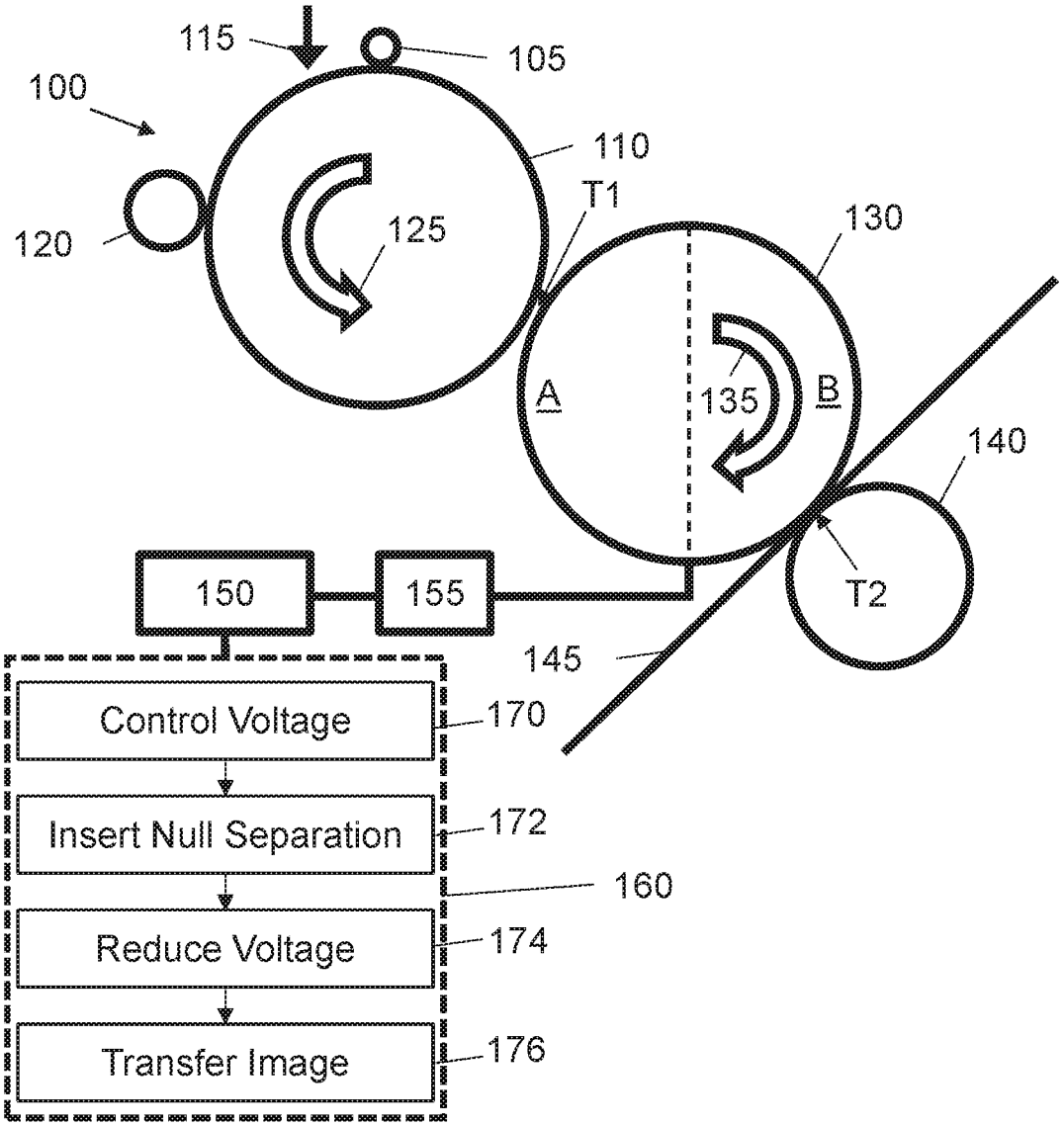
FIG. 1 is a schematic diagram showing a cross section of a print engine in a liquid electrophotographic printer according to an example.

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

As described herein, an example electrophotographic printer in the form of a liquid electrophotographic (LEP) printer comprises an imaging element such as a photo imaging member, which can be referred to as a photo imaging plate (PIP). The photo imaging plate may be implemented, for example, as a drum or a belt. A charging element charges the photo imaging plate and a latent image is generated on the photo imaging plate. At least one image development unit deposits a charged layer of printing fluid onto the photo imaging plate. In one example, each image development unit deposits a different colored layer of printing fluid onto the photo imaging plate. Those skilled in the art will appreciate that some areas of the photo imaging plate will be charged, and charge in some other areas will have been dissipated by the lasers in generating the latent image. The areas where the layer of printing fluid is applied will form the inked image and the remaining areas will be background areas which do not contain printing fluid. An example printing fluid in the form of liquid toner comprises ink particles and a carrier liquid. The ink or pigment particles are charged and may be arranged upon the photo imaging plate based on a charge pattern of a latent image. The inked image comprises ink particles that are aligned according to the latent image. In an example, the ink particles may be in the order of about 1-2 microns in diameter.

An intermediate transfer member (ITM) receives the inked image from the photo imaging plate and transfers the inked image to a print substrate. In order to transfer the image from the photo imaging plate to the ITM, the photo imaging plate and the ITM may engage one another and move relative to one another. For example, the photo imaging plate and the ITM may rotate relative to one another. In one example, the ITM is heatable. The ITM may comprise a drum or belt wrapped with a blanket. In an example, the ITM is supplied with a high voltage, such as +500V to +600V, in order for the first electrical transfer of printing fluid from the PIP to the blanket. A second transfer, from the blanket to a print substrate, takes place as the ink comes into contact with the substrate, owing to a temperature differential between the blanket, which has been heated, and the cooler substrate; the ink solidifies, sticks to the substrate and peels off the blanket, leaving the blanket clean and ready to accept a new ink layer. However, in the case of printing to a metallized substrate, electrostatic discharge issues can occur owing to the high voltage that is applied to the ITM drum.

In order to allow printing on a conductive substrate, cumbersome workarounds may be employed in comparative systems to prevent the occurrence of high voltage breakdown between the biased ITM and the substrate. These voltage breakdowns are exhibited as violent sparks on the substrate, which can damage it. Comparative solutions may involve the use of insulating ITM drum bearings which are expensive. Furthermore, these bearings have a short life span meaning difficult, regular maintenance is involved.

In order to mitigate such discharge issues, the high voltage applied to the ITM drum can be turned off when the second transfer is taking place. However, this is not practical when a "two-page" print is being carried out by the ITM, that is, when two separate images are being developed on separate portions of the ITM. In such a situation, two portions of the ITM are in different stages of image development at a given moment, and a first image cannot be transferred to a conductive substrate simultaneously to the ITM receiving a color separation of a second image from the PIP.

In the present examples, a sequence of separation printing, which includes "null" separations between ink color separations, allows a first transfer to take place when there is no print substrate in contact with the ITM blanket (and conversely, the print substrate is printed to during the null separation when there is no "first transfer" taking place between the PIP and the blanket). A null separation occurs when there is no transfer of a color separation from the PIP to the ITM blanket as the PIP and ITM move, e.g. rotate, relative to one another. For example, a null separation may involve a period where there is no latent image on the PIP or no image development unit is engaged with the PIP, such that no liquid toner is applied by the image development units. This is turn leads to a period where there is no developed image (e.g. in the form of a layer of ink) to transfer from the PIP to the ITM. The null separations are inserted to eliminate the electrostatic discharge issues noted above, while ensuring an efficient print cycle in a two-page print process. Such a print sequence can also take into account the rise and fall time of the high voltage power supply provided to the ITM, e.g. may allow the voltage to be reduced or turned off for longer than the exact substrate contact time.

FIG. 1 is a schematic diagram showing a liquid electrophotographic (LEP) printer 100 in accordance with an example, although it should be appreciated that other examples may be printers that use a dry printing substance. Liquid electrophotography, sometimes also known as Digital Offset Color printing, is the process of printing in which printing fluid such as liquid toner is applied onto a surface having a pattern of electrostatic charge (i.e. a latent image) to form a pattern of liquid toner corresponding with the electrostatic charge pattern (i.e. an inked image). This pattern of liquid toner is then transferred to at least one intermediate surface, and then to a print medium or substrate. During the operation of a digital liquid electrophotographic system, ink images are formed on the surface of a photo imaging plate. These ink images are transferred to the blanket of an intermediate transfer member and then to a print medium.

According to the example of FIG. 1, a latent image is formed on a photo imaging member, which can be referred to as a photo imaging plate (PIP) 110 by rotating a clean, bare segment of the PIP 110 under a charging element 105. The PIP 110 in this example is cylindrical in shape, e.g. is constructed in the form of a drum, and rotates in a direction of arrow 125; however, a photo imaging member or photo imaging plate may be planar or part of a belt-driven system. The charging element 105 may include a charging device, such as corona wire, a charge roller, scorotron, or any other charging device. A uniform static charge is deposited on the PIP 110 by the charging element 105. In one example, a voltage of between −900V and −1100V is applied to the charging element 105 to enable charging. As the PIP 110 continues to rotate, it passes an imaging unit 115 where one or more laser beams dissipate localized charge in selected portions of the PIP 110 to leave an invisible electrostatic charge pattern that corresponds to the image to be printed, i.e. a latent image. In some implementations, the charging element 105 applies a negative charge to the surface of the PIP 110. In other implementations, the charge is a positive charge. The imaging unit 115 then locally discharges portions of the PIP 110, resulting in local neutralized regions on the PIP 110.

In the described example, printing fluid such as ink is transferred onto the PIP 110 by at least one image development unit 120. An image development unit may also be referred to as a Binary Ink Developer (BID) unit. There may be one image development unit 120 for each ink color. During printing, the appropriate image development unit 120 is engaged with the PIP 110. The engaged image development unit 120 presents a uniform film of ink to the PIP 110. The ink contains electrically-charged pigment particles which are attracted to the opposing charges on the image areas of the PIP 110. The PIP 110 now has a single color ink image on its surface, i.e. an inked image or separation. In other implementations, such as those for black and white (monochromatic) printing, one or more ink developer units may alternatively be provided.

The ink may be a liquid toner, comprising ink particles and a carrier liquid. The carrier liquid may be an imaging oil. An example liquid toner ink is HP ElectroInk™. In this case, pigment particles are incorporated into a resin that is suspended in a carrier liquid, such as Isopar™. The ink particles may be electrically charged such that they move when subjected to an electric field. Typically, the ink particles are negatively charged and are therefore repelled from the negatively charged portions of PIP 110, and are attracted to the discharged portions of the PIP 110. The pigment is incorporated into the resin and the compounded particles are suspended in the carrier liquid. The dimensions of the pigment particles are such that the printed image does not mask the underlying texture of the print substrate, so that the finish of the print is consistent with the finish of the print substrate, rather than masking the print substrate. This enables liquid electrophotographic printing to produce finishes closer in appearance to offset lithography, in which ink is absorbed into the print substrate.

The ink is transferred from the PIP 110 to the ITM 130. The ITM 130 may also be known as a blanket cylinder or a transfer element and may take the form of a rotatable drum, belt or other transfer system. In the example of FIG. 1, the ITM 130 rotates in the direction of arrow 135. The transfer of an inked image from the PIP 110 to the ITM 130 may be known as the "first transfer", which takes place at a point of engagement T1 between the PIP 110 and the ITM 130. The first transfer of the layer of liquid toner is affected by the potential difference that exists between the liquid toner and the ITM 130. In an example, the voltage applied to the ITM 130 is between +500V and +600V.

Once the layer of liquid toner has been transferred to the ITM 130, it is transferred to a print substrate 145. This transfer from the ITM 130 to the print substrate may be deemed the "second transfer", which takes place at a point of engage T2 between the ITM 130 and the substrate 145. The impression cylinder 140 can both mechanically compress the substrate 145 in to contact with the ITM 130 and also help feed the substrate 145. In one example, the impression cylinder 140 is grounded. The present electrophotographic printer is capable of printing on either conductive or non-conductive substrates. Non-conductive substrates may include: sheets of metal; metal-coated paper or cardboard; or substrates with metal areas or parts.

In an example, the ITM 130 is used as a "two-sided" or "two-page" intermediate transfer drum to develop two images on different portions of the ITM 130 at a time. Image development units 120 deposit respective first and second sequences of color separations onto the PIP 110. The ITM 130 has a first portion (an example of which is shown as portion A in FIG. 1) to receive the first sequence of color separations from the PIP 110 and a second portion (an example of which is shown as portion B in FIG. 1) to receive the second sequence of color separations from the PIP 110. The PIP 110 and ITM 130 can be rotatable drums that rotate relative to one another, such that the color separations are transferred during the relative rotation.

The print method may be a "one-shot" imaging process as described previously. The sequences are controlled so that, during the second transfer of the first developed image to a conductive substrate 145, there is no first transfer of a color separation of the second image from the PIP 110 to the ITM 130, and conversely, no image is printed to the conductive substrate when a first transfer of a color separation between the PIP 110 and the ITM 130 is taking place.

Controller 150, discussed in more detail below, controls part, or all, of the print process. A memory 160 may comprise a set of computer-readable instructions stored thereon to perform functions such as controlling a voltage 170, inserting a null separation 172, reducing a voltage 174 and transferring an image 176, as explained further below. Alternatively, these functions may be implemented in dedicated circuitry. For example, the controller 150 can control the voltage level applied by a voltage source 155, for example a power supply, to the ITM 130 in accordance with the rotation of the ITM 130. The ITM 130 voltage is selectively applied such that the ITM 130 receives each color separation from the PIP 110. The controller 150 inserts at least one null separation into the second sequence of color separations during the development of the second image. During a period for the null separation, the controller 150 controls the voltage source 155 to reduce the voltage applied to the ITM 130, and to transfer the first image to the conductive substrate 145. The voltage source 155 is reduced to a low enough voltage in order that electrostatic charging/discharging issues are not introduced when printing to the conductive substrate 145. The voltage source 155 may be reduced to approximately 0V, for example by turning off an associated power supply.

It will be appreciated that the controller 150 can also control any other, or all of the components of the printer 100, however connections between those elements and the controller are not shown in FIG. 1 for clarity. Furthermore, controller 150 may also be embodied in one or more separate controllers. The controller 150 may comprise a microprocessor and a memory. The LEP printer 100 comprises electronic circuitry to receive a control signal from the microprocessor and, in response, to cause the voltage source 155 to reduce the voltage applied to the ITM 130.

Figure 2:
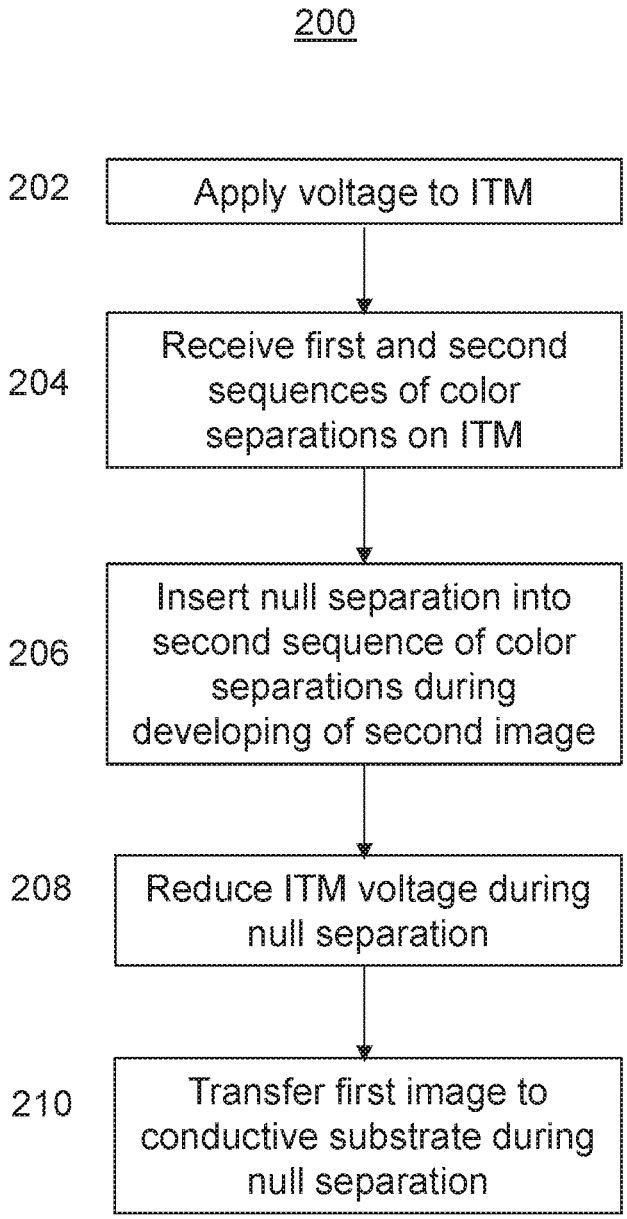
FIG. 2 is a flow diagram showing a method of printing images in a liquid electrophotographic printer, according to an example.

FIG. 2 shows an example method of printing images in an LEP printer 100. At block 202, a voltage is applied to the ITM 130 during receipt (at block 204) of each color separation from the PIP 110. As described previously, the first sequence of color separations is received from the PIP 110 to develop the first image on a first portion of the ITM 130, while the second sequence of color separations is received from the PIP 110 to develop a second image on a second portion of the ITM 130. At block 206, during the developing of the second image, at least one null separation is inserted by the controller 150 into the second sequence of color separations. This insertion may include generating control data that includes the null separation, e.g. as compared to control data that does not include the null separation. At block 208, during a period for the null separation, a voltage applied to the ITM by the voltage source 155 is reduced by the controller 150, and the first image is transferred (block 210) a conductive substrate.

Figure 3A:
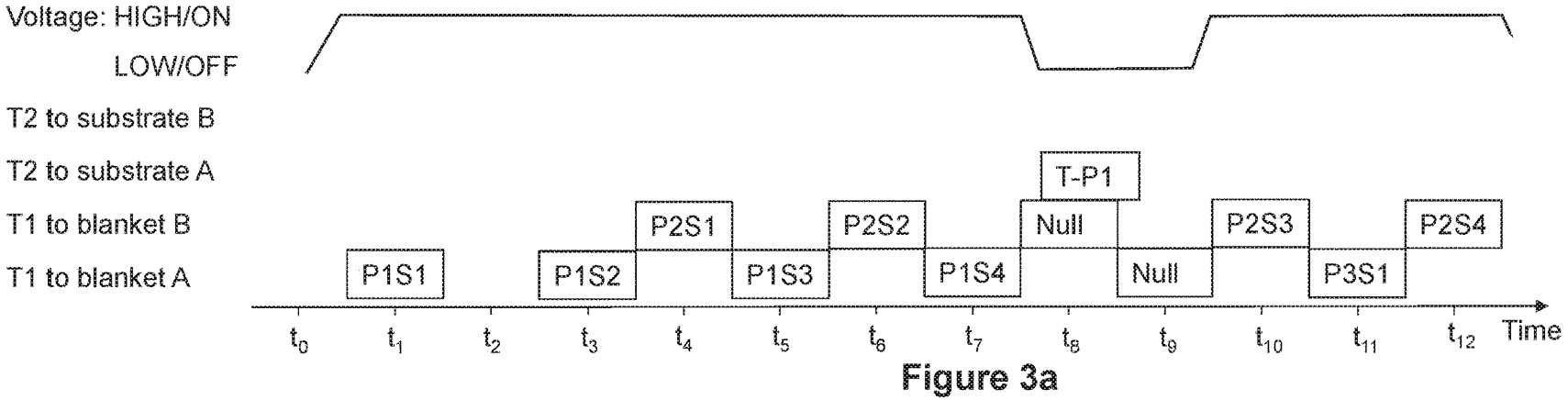
FIGS. 3*a* and 3*b* show a one-shot print sequence, according to an example.
Figure 3B:
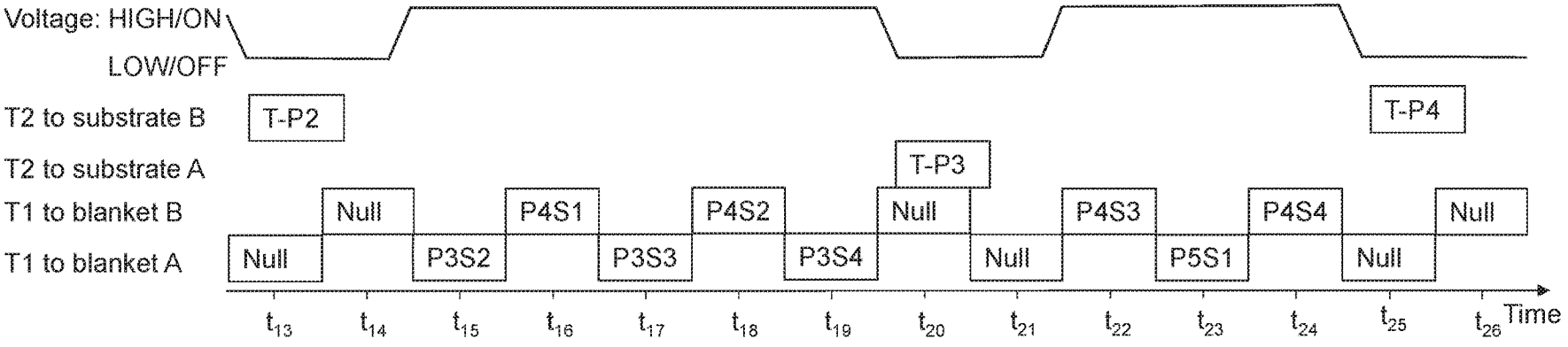

FIGS. 3*a* and 3*b* show a more detailed example method of printing images in an LEP printer 100. FIG. 3*b* is a continuation of FIG. 3*a* over predetermined and equal time periods $t_0$ to $t_{26}$. Each time period corresponds to a half a rotation of the ITM 130, that is, an 180° rotation of the cylindrical drum shown in FIG. 1. In this example, each image may take up approximately 150° of the perimeter of the ITM 130 blanket. A voltage level that is supplied to the ITM 130 using voltage source 155 is shown to be HIGH/ON or LOW/OFF in accordance with times $t_0$-$t_{26}$ shown on the horizontal axis. The vertical axes of FIGS. 3*a* and 3*b* indicate: a first transfer (at the point of engagement, T1, between the PIP 110 and the ITM 130) to a first portion of the ITM 130 (blanket A); a first transfer (at point T1) to a second portion of the ITM 130 (blanket B); a second transfer (at the point of engagement, T2, between the ITM 130 and the conductive substrate 145) to the first portion of the ITM 130 (blanket A); a second transfer (at T2) to a second portion of the ITM 130 (blanket B). Each transfer is represented by a block indicating an action at a particular time, where P1 is a first image to be printed, P2 is a second image to be printed, and S1-S4 represent the individual color separations that are transferred for each respective image, as explained further below. In this example, there are four color separations, but images comprising fewer or more color separations can also be printed using the printing method of FIG. 2.

Referring to FIG. 3*a*, at time $t_0$, the voltage is applied to the ITM (for example, by turning a power supply attached to the ITM 130 up or on) as the development of images onto the ITM 130 begins. The PIP 110 and ITM 130 rotate at constant process velocities relative to one another, and at time $t_1$ block P1S1 indicates that a first color separation of a first image is transferred from the PIP 110 to a first portion, blanket A, of the ITM 130. At time $t_2$, the high voltage level is maintained but there is no transfer of a color separation to the ITM 130. This can be referred to as a "dummy" phase and ensures that in subsequent color separation transfers, separations of the same color are not transferred to portions A and B of the ITM 130 at adjacent times $t_x$, $t_{x+1}$. For example, if separation S1 is magenta and separation S2 is cyan, it can be seen from FIG. 3*a* that by inserting the dummy phase at time $t_2$, blocks P1S1 and P2S1 are spaced from one another, and blocks P1S2 and P2S2 are correspondingly spaced, which eases pressure on the system and allows the appropriate image development unit 120 to prepare for the next color separation transfer.

At time $t_7$, block P1S4 indicates that the fourth separation of the first image is transferred onto the first portion of the ITM 130. As each image in this example has four color separations, the transfer of the first image onto the ITM 130 blanket is now complete, and the first image is ready to be transferred to the conductive substrate 145. As can be seen from FIG. 3*a*, the transfer of the first image to the conductive substrate 145 occurs when a subset of the second sequence of color separations have been received on the second portion of the ITM 130. In this example, the first and second color separations (S1, S2) of image P2 have been transferred to blanket B.

At time $t_8$, the controller 150 inserts a null separation into the second sequence of color separations, so that no color separation transfer occurs between the PIP 110 and the ITM 130. During the null separation, the controller 150 also reduces the voltage applied by the voltage supply 155 to the ITM 130 to the LOW/OFF level. The second transfer of the first image (T-P1) from the ITM 130 to the conductive substrate (in this example, substrate A) can then take place during the null separation. A second null cycle can be introduced at time $t_9$, because in the example of FIG. 1, the location T2 at which the ITM 130 meets the substrate 145 is not directly opposite the location T1 of the first transfer between the PIP 110 and the ITM 130.

As shown in FIG. 3*b*, second transfers of a second image (T-P2), a third image (T-P3) and a fourth image (T-P4) can also take place during subsequent null separations that are inserted into the print cycle at appropriate times by the controller 150. These times may be the optimum times at which to transfer the respective images, based on the final separation for the respective images being received on the ITM 130 blanket and the position of each portion of the ITM 130 drum.

FIGS. 3*a* and 3*b* also show that there may be a time period during which the voltage decreases and increases once the controller has instructed the voltage source to reduce or increase, respectively, the voltage applied to the ITM 130. This rise and fall time of a high voltage power supply means that the power supply may be enabled to lower or turn off the applied voltage for longer than the exact ITM-substrate contact time during the second transfer. The insertion of appropriate null separations by the controller 150 ensures that the second transfer takes place when the voltage is at a suitably low level, and that no transfers take place during the voltage rise and fall periods.

As shown by blocks P3S1-P3S4, a third image P3 can be developed on the first portion (blanket A) of the ITM 130 by receiving a third sequence of color separations from the PIP 110 after the first image P1 has been transferred to a conductive substrate. In this example, the term "substrate A" is used to show that the third image is developed from blanket A, that is, the first portion of the ITM 130; however, it should be appreciated that the third image may, in practice, be printed onto a different physical substrate to the substrate to which the first image P1 has been printed. During the development of the third image, at least one null separation is inserted by the controller into the third sequence of color separations. During a period of time for the null separation, the ITM 130 voltage is reduced and the second image P2 is transferred at block T-P2 to a second conductive substrate. The second conductive substrate may be separate to, or part of, the first conductive substrate. For example, the first and second substrates may be first and second portions, respectively, of a continuous web substrate. As shown in FIG. 3*b*, similar print cycles may be repeated for subsequent images, with up to two images being developed on the ITM 130 at any given time.

FIG. 4*a* is a table illustrating the example sequence of FIG. 3; the numbers indicate a color separation number that is received at each of blankets A and B, running in time order from the top to the bottom of the table. The term "n" indicates that a null separation is inserted into the print cycle, while "dummy" indicates the insertion of a dummy phase. FIGS. 4*b* and 4*c* illustrate similar tables in the case of an image having three color separations and five color separations, respectively.

FIGS. 4*a*-4*c* provide example print cycles in which the voltage rise and fall is relatively fast. By contrast, FIGS. 5*a*, 5*b* and 5*c* show examples of print cycles having 4, 3 and 5 color separations, respectively, which may be employed in the case of a longer duration of voltage rise or fall.

Figure 6:
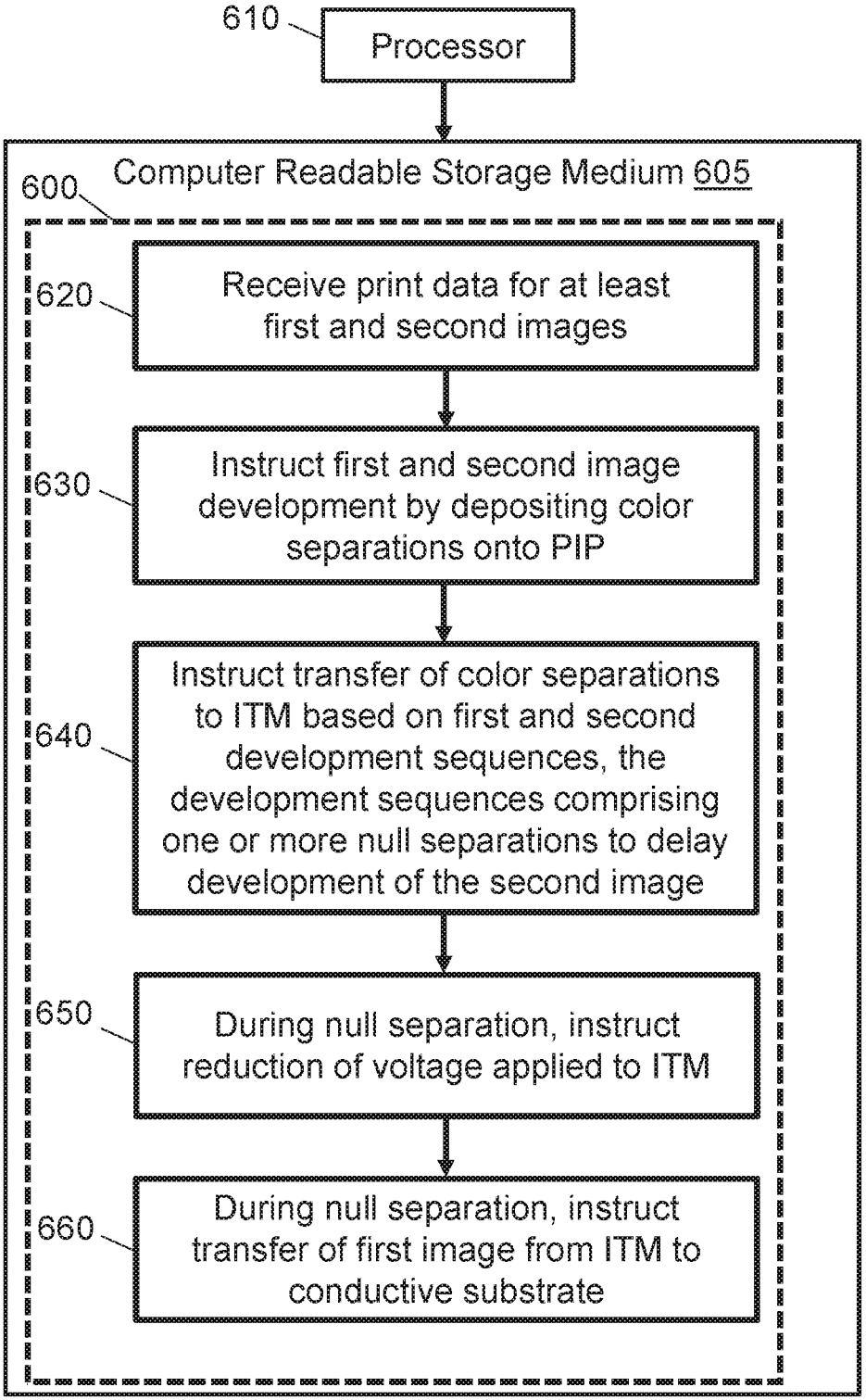
FIG. 6 is a non-transitory computer readable storage medium comprising a set of computer-readable instructions to be carried out by a processor, according to an example.

Referring to FIG. 6, an example of a non-transitory computer readable storage medium 605 may comprise a set of computer-readable instructions 600 stored thereon. The instructions are executed by a processor 610 which may form part of the controller 150 of the example LEP printer of FIG. 1. The instructions are executed by the processor 610 and cause it to carry out the illustrated tasks. At block 620, the processor 110 receives print data for at least a first image and a second image to be printed to the conductive substrate 145. At block 630, the processor 610 instructs development of first and second images by depositing color separations of printing fluid from at least one image development unit 120 onto a PIP 110 of the LEP. The processor 610 then instructs, at block 640, transfer of the color separations from the PIP 110 to the ITM 130 in accordance with the respective first and second separation development sequences. The first and second separation development sequences comprise one or more null separations to delay development of the second image. During the one or more null separations, the processor 610 (i) instructs (at block 650) a reduction in the voltage applied by the voltage source 155 to the ITM 130 and (ii) instructs transfer (at block 660) of the first image from the ITM 130 to the conductive substrate 145.

While certain examples have been described above in relation to liquid electrophotographic printing, other examples can be applied to dry electrophotographic printing.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A method of printing images in an electrophotographic printer, the method comprising:

developing a first image on a first portion of an intermediate transfer member by receiving a first sequence of color separations from a photo imaging member; and developing a second image on a second portion of the intermediate transfer member by receiving a second sequence of color separations from the photo imaging member, wherein the method comprises:

applying a voltage to the intermediate transfer member during receipt of each color separation from the photo imaging member, and wherein during the developing of the second image, the method comprises:

inserting at least one null separation into the second sequence of color separations, and during a period for the null separation:

reducing a voltage applied to the intermediate transfer member, and transferring the first image to a conductive substrate, wherein the transfer of the first image to the conductive substrate occurs when a subset of the second sequence of color separations have been received on the second portion of the intermediate transfer member.

2. The method of claim 1, comprising developing a third image on the first portion of the intermediate transfer member by receiving a third sequence of color separations from the photo imaging member after the first image has been transferred to a first conductive substrate;

wherein during the developing of the third image, the method comprises:

inserting at least one null separation into the third sequence of color separations, and during a period for the null separation:

reducing a voltage applied to the intermediate transfer member, and transferring the second image to a second conductive substrate.

3. The method of claim 2, wherein the first conductive substrate and the second conductive substrate comprise first and second portions, respectively, of a continuous web substrate.

4. The method of claim 1, wherein the intermediate transfer member and the photo imaging member are rotatable, and the method comprises:

rotating the intermediate transfer member and the photo imaging member relative to one another; and receiving each color separation on the intermediate transfer member from the photo imaging member during said relative rotation.

5. The method of claim 1, wherein reducing the voltage comprises turning off the voltage supply.

6. The electrophotographic printer of claim 1, wherein the intermediate transfer member and the photo imaging member comprise rotatable drums, and the method comprises:

rotating the intermediate transfer member and the photo imaging member relative to one another; and receiving each color separation on the intermediate transfer member from the photo imaging member during said relative rotation.

7. An electrophotographic printer comprising:

a photo imaging member;

at least one image development unit to develop first and second images by depositing respective first and second sequences of color separations onto the photo imaging member;

an intermediate transfer member having a first portion to receive the first sequence of color separations from the photo imaging member and a second portion to receive the second sequence of color separations from the photo imaging member;

a voltage source to selectively apply a voltage to the intermediate transfer member; and a controller to:

control the voltage source such that the intermediate transfer member receives each color separation from the photo imaging member;

insert at least one null separation into the second sequence of color separations during the development of the second image; and during a period for the null separation, control the voltage source to:

reduce a voltage applied to the intermediate transfer member, and transfer the first image to a conductive substrate, wherein the controller is provided to transfer the first image to the conductive substrate when a subset of the second sequence of color separations have been received on the second portion of the intermediate transfer member.

8. The electrophotographic printer of claim 7, wherein the at least one image development unit is provided to develop a third image by depositing a third sequence of color separations onto the photo imaging member, and wherein the third sequence of color separations is received on the first portion of the intermediate transfer member after the first image has been transferred to a first conductive substrate; and wherein the controller is provided to, during the developing of the third image:

insert at least one null separation into the third sequence of color separations, and during a period for the null separation:

reduce a voltage applied to the intermediate transfer member, and transfer the second image to a second conductive substrate.

9. The electrophotographic printer of claim 8, wherein the first conductive substrate and the second conductive substrate comprise first and second portions, respectively, of a continuous web substrate.

10. The electrophotographic printer of claim 7, wherein the controller is provided to turn off the voltage supply during the period for the null separation.

11. The electrophotographic printer of claim 7, wherein the controller comprises a microprocessor and a memory.

12. The electrophotographic printer of claim 11, comprising electronic circuitry to receive a control signal from the microprocessor and, in response, to cause the voltage source to reduce the voltage applied to the intermediate transfer member.

13. A non-transitory computer readable storage medium comprising a set of computer-readable instructions stored thereon, which, when executed by a processor, cause the processor to, in an electrophotographic printer:

receive print data for at least a first image and a second image to be printed to a conductive substrate;

instruct development of the first and second images by depositing color separations of a printing substance from at least one image development unit onto a photo imaging plate of the electrophotographic printer;

instruct transfer of said color separations from the photo imaging plate to the intermediate transfer member in accordance with respective first and second separation development sequences of the color separations, wherein the development sequences comprise one or more null separations to delay development of the second image; and during the one or more null separations:

instruct a reduction of a voltage applied to the intermediate transfer member, and instruct transfer of the first image from the intermediate transfer member to a conductive substrate, wherein the transfer of the first image to the conductive substrate occurs when a subset of the coloration separations of the second separation development sequence has been received on the intermediate transfer member.

* * * * *